United States Patent [19]

Hayes

[11] 4,367,253

[45] Jan. 4, 1983

[54] MOLDABLE ARTICLE HAVING ABRASIVE CHARACTERISTIC FOR USE IN SANDING IRREGULAR SURFACES

[76] Inventor: Linda D. Hayes, 1459 Princeton Dr., San Jose, Calif. 95118

[21] Appl. No.: 87,502

[22] Filed: Oct. 23, 1979

Related U.S. Application Data

[63] Continuation of Ser. No. 661,422, Feb. 26, 1976, abandoned.

[51] Int. Cl.[3] ..... B24D 3/02

[52] U.S. Cl. ..... 428/75; 51/308; 51/DIG. 19; 51/DIG. 20; 428/240; 428/241; 428/454

[58] Field of Search ..... 51/294, 297, 302, 308, 51/DIG. 19, DIG. 20; 428/240, 241, 454, 75

[56] References Cited

U.S. PATENT DOCUMENTS

| | | | |
|---|---|---|---|
| 2,026,638 | 1/1936 | Kingman | 51/308 |
| 2,053,360 | 9/1936 | Benner | 51/DIG. 19 |
| 2,347,244 | 4/1944 | Colt | 51/294 |
| 3,813,231 | 5/1974 | Gilbert et al. | 51/298 |

*Primary Examiner*—Marion McCamish
*Attorney, Agent, or Firm*—John J. Leavitt

[57] ABSTRACT

Presented is a body of moldable material enveloped in a filament conformable to the shape assumed by the moldable material and having dispersed on selected areas thereof abrasive material conformable with the surface to which it is adhered corresponding to irregular shapes to be sanded.

9 Claims, 15 Drawing Figures

MOLDABLE ARTICLE HAVING ABRASIVE CHARACTERISTIC FOR USE IN SANDING IRREGULAR SURFACES

This is a continuation of application Ser. No. 661,422, filed Feb. 26, 1976, now abandoned.

BACKGROUND OF THE INVENTION

There has been a continuing problem in the refinishing or irregular objects in abrading or sanding irregular surfaces and crevices to which the relatively stiff conventional abrasive "papers" do not conform. Accordingly, it is one of the principal objects of the invention to provide a mass or body of material plastic in the sense that it is moldable into any specific configuration that is required to be abraded, the body or mass having an abrasive exterior surface which may be made to conform to the configuration desired to be abraded.

There are a number of materials on the market that are plastic in the sense that they may be molded. Ordinary clay is one such material. However, most such materials remain moldable or plastic only so long as they are not exposed to the ambient atmosphere. Accordingly, it is another object of the invention to provide such a mass or body of plastic or moldable material that is encased within a membrane that is impervious to air so that the plastic material remains sealed within the membrane, the membrane in turn having abrasive material adherent to its exterior surface so that when the body of plastic material is molded to conform to an intricate shape required to be abraded, the membrane and its adherent abrasive similarly conforms to that configuration.

In some instances it may not be of importance to preserve the integrity of the mass of moldable material. In such instances, it may be possible to utilize a small amount of such moldable material that may be discarded after use. Accordingly, another object of the invention is the provision of a flexible and deformable membrane in the form of a flat sheet on which is adherent a layer of abrasive material, the flexible sheet being conformable about the body of moldable material so that it conforms to whatever shape the moldable material is formed into.

The invention possesses other objects and features of advantage, some of which with the foregoing, will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the moldable article having an abrasive surface in one of its aspects comprises a plastic mass conformable to almost any desired shape and having an abrasive exterior surface that conforms to whatever shape the mass is formed. In another aspect of the invention, the moldable article comprises a mass of plastic material moldable into almost any desirable configuration, and having thereabout an impervious membrane which seals the plastic material therewithin and which carries on its exterior surface a layer of abrasive material adherent to the membrane. In a third aspect, the invention contemplates the manufacture and sale as an article of manufacture a flat sheet of moldable material having adherent thereon a layer of abrasive material, the flat sheet-like material being moldable to conform to intricate shapes.

DESCRIPTION OF THE PREFERRED EMBODIMENT

In terms of greater detail, the moldable article having an abrasive surface comprises a novel combination of elements which may be manipulated to conform to any given shape that the user desires to abrade. The exterior surface of the moldable mass or body has an abrasive characteristic, and is moldable or formable into intricate configurations to match the configurations of the article to be abraded. It should be understood that it is believed that the combination of elements to accomplish these results is novel and inventive, as is one or more sub-combinations of the combination. In this respect, and referring specifically to FIGS. 1 and 2, there is there shown one element of the combination, comprising a rectilinear sheet 2, preferably a woven material cut on the bias so that the flat sheet of material may be formed into various configurations, dependent upon the surfaces to be abraded. Deposited in an area generally centrally disposed on the rectilinear sheet is a layer 3 of an appropriate adhesive, the adhesive permeating the filaments or threads that make up the woven fabric, if such filaments or threads are capable of being permeated, and/or filling the interstices between the filaments or threads and adhering to the exterior surfaces of the threads themselves whether or not the filaments or threads have the capability of absorbing the adhesive. The intent here is to create a layer of adhesive material that is strongly adherent in a mechanical sense to the underlying sheet of woven material.

Disposed on the layer of adhesive material is a layer 4 of abrasive material, the abrasive conveniently being any of the multitudes of different materials that are conventionally used for this purpose. For instance, in some instances it may be feasable to use particles of silica, while in other instances it might be preferable to use other materials such as carborundum powder, or even diamond dust. It is not intended that there should be any limit imposed with respect to the type of abrasive material deposited and adherent to the layer of adhesive.

Figure 1:
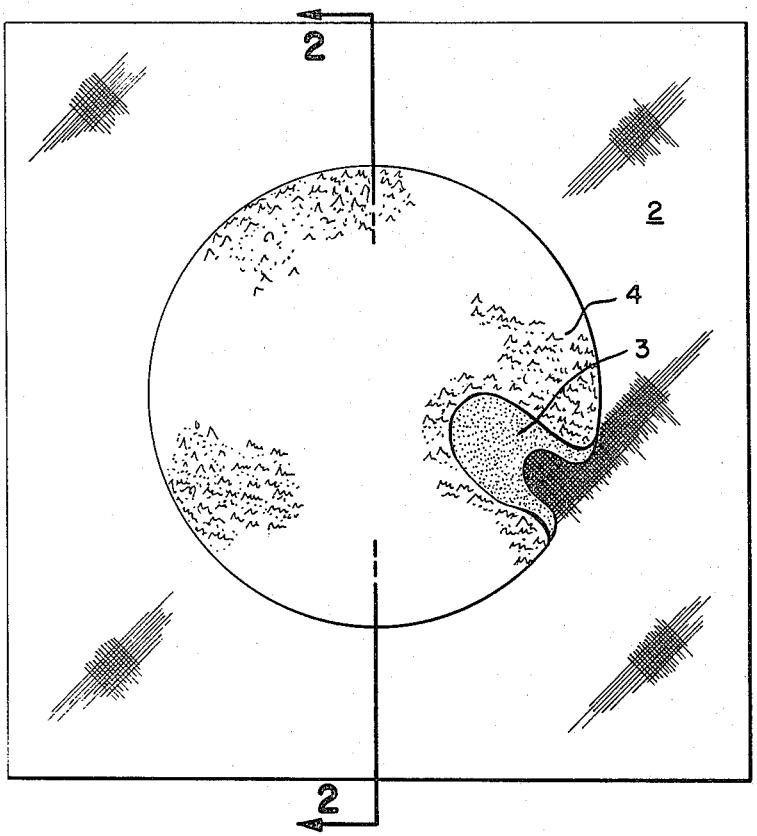
FIG. 1 is a plan view of a rectilinear sheet of moldable material having dispersed thereon an adherent layer of abrasive material.
Figure 2:
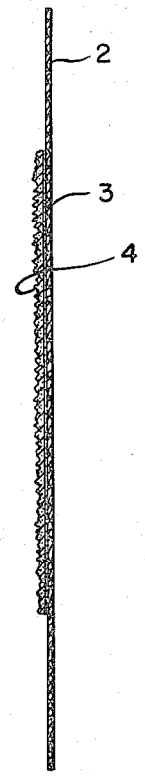
FIG. 2 is a vertical cross-sectional view taken in the plane indicated by the line 2—2 of FIG. 1.
Figure 3:
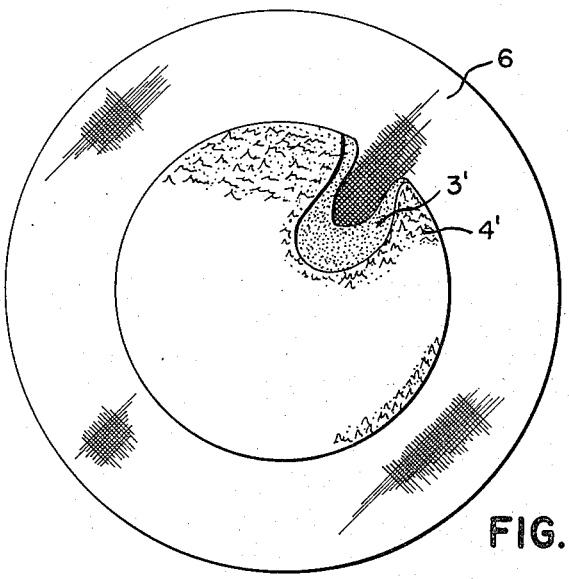
FIG. 3 is a view similar to FIG. 1, but showing the adhesively adherent abrasive material adherent to one surface of a circular sheet of flexible and moldable material.

While the backing or support member 2 in FIGS. 1 and 2 is illustrated as being rectilinear, even square, this backing or support member may be circular as illustrated in FIG. 3, where the backing member 6 is fabricated from a similar woven material cut on the bias, and is again provided in a centrally disposed area with a layer 3' of adhesive of the same type discussed above in connection with the construction illustrated in FIG. 1. In like manner, the layer of adhesive 3' is covered with an adherent layer 4' of a suitable abrasive material, there being no limit to the types of abrasive materials that may be used.

Figure 4:
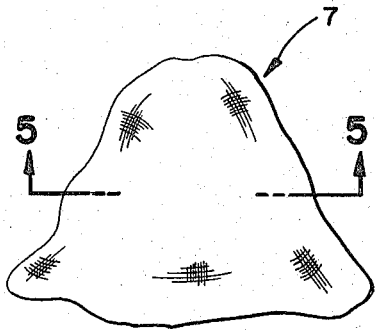
FIG. 4 is a perspective view of a mass of moldable material.
Figure 13:
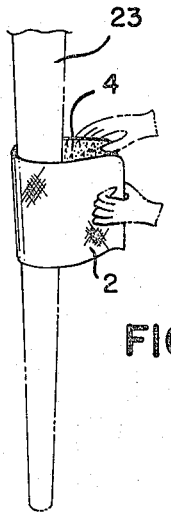
FIG. 13 is a perspective view illustrating the use of the sheet of formable and abrasive material illustrated in FIG. 1 being used to abrade a cylindrical spindle.

While it is obvious that the product illustrated in FIGS. 1 and 2 may be used independently of any other structure, for instance, in the manner illustrated in FIG. 13, there are instances in which it is desirable to provide an additional support for the abrasive material in the form of a mass or body of plastic or moldable material that may be manipulated to conform it to intricate shapes such as illustrated in FIGS. 6 through 10, and 13 and 14. To this end, there is illustrated in FIG. 4 a mass 7 of material completely enveloped in a membrane 8 illustrated in FIG. 5, the membrane 8 being exceedingly thin and preferably impervious to moisture or fluids of all kinds. In this way, the mass of moldable material, particularly if it is the type which remains moldable or plastic only so long as certain solvents remain dispersed through the material, is prevented from drying out and hardening to the point that it may no longer be manipulated and formed into the intricate shapes desired. Preferably, the membrane 8 is deformable in the same sense that the mass that it encloses is deformable, and is non-resilient so that once formed into an intricate shape it will retain such shape until it is again manipulated into a different shape.

In other instances, it may be unnecessary that the moldable or plastic body or mass be retained for any length of time, it being sufficient that its moldability or plasticity remain only so long as a specific job is performed. In such instance, the mass of material may merely be a mass of plastic or moldable material as illustrated at 9 in FIG. 5*a*, the mass being devoid of any kind of an impervious membrane thereabout. If the mass dries to the point that it cannot be molded or formed into whatever shape is desired, the mass is merely discarded and a new quantity of the material is utilized in conjunction with one or the other of the abrasive sheets illustrated in FIGS. 1 and 3.

Figure 5A:
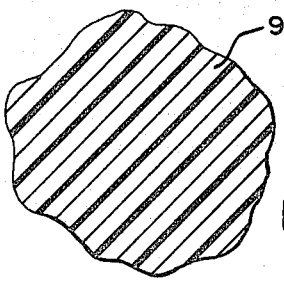
FIG. 5*a* is a cross-sectional view taken in the plane indicated by the line 5—5 in FIG. 4, and illustrating a mass of such material without the encasing membrane.
Figure 6:
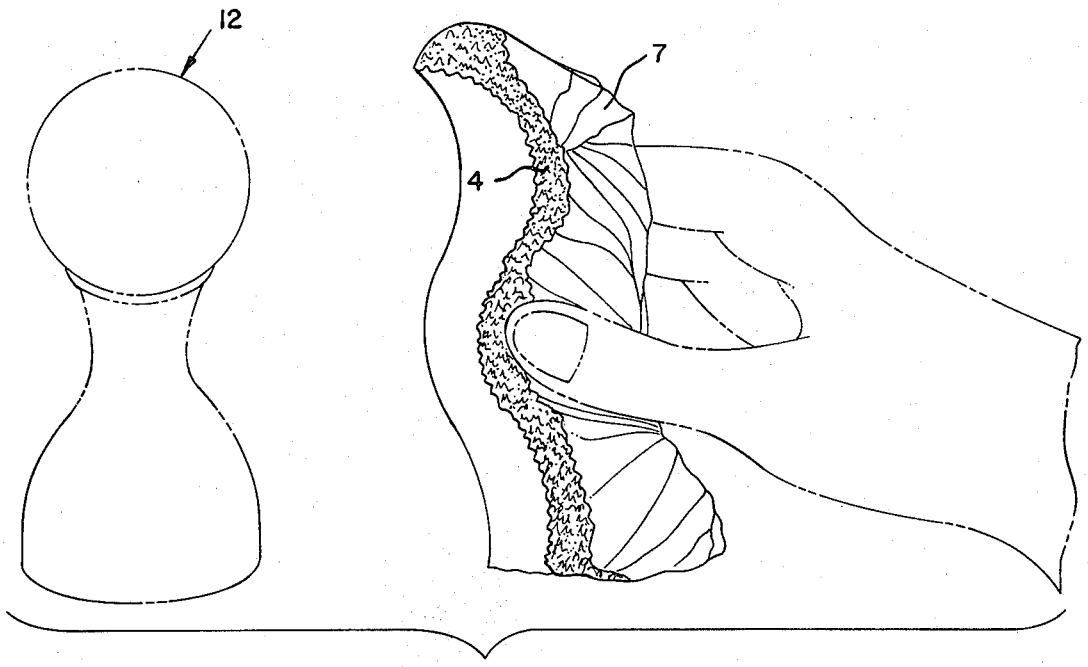
FIG. 6 is a perspective view illustrating how the body of moldable material may be formed to conform to the configuration of an article to be abraded, the molded mass of material being shown in full lines while the hand grasping the mass of material and the article to be abraded are shown in broken lines.
Figure 7:
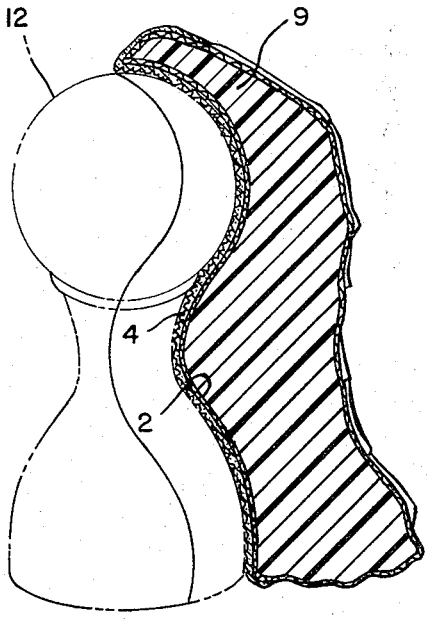
FIG. 7 is a view illustrating in broken lines the configuration of an article to be abraded and in full lines the application of the body of plastic or moldable material having an abrasive surface thereon and applied to the surface of the article to be abraded.

FIGS. 6 through 10, inclusive, illustrate different ways in which the invention may be utilized. In FIG. 6 there is shown an article 12 having an irregular configuration with the body of moldable material 7 manipulated and formed to generally conform to the exterior configuration of the article. The view shows the mass of moldable material 7 having an abrasive surface 4 thereon and being held by a hand in preparation of application of the abrasive surface to the exterior surface of the article to be abraded. In FIG. 7, the body of plastic or moldable material 7 is shown in section so as to illustrate a mass of the material as illustrated in FIG. 5*a* having draped therearound one of the sub-assemblies illustrated in FIGS. 1 or 3, without the use of an impervious membrane about the mass 9 of moldable or plastic material. Thus, the abrasive 4 is placed in direct contact with the article to be abraded, while the backing member 2 is in direct contact with the exterior surface of the mass 9 of plastic or moldable material. In the interest of clarity, the layer of adhesive material 3 is not illustrated in this figure, it being understood however that such layer of adhesive material causes the abrasive material 4 to adhere strongly to the woven support member 2 on which it is supported.

Figure 5:
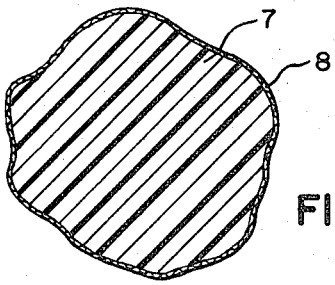
FIG. 5 is a cross-sectional view through a mass of moldable material such as illustrated in FIG. 4, the mass being sealingly encased in a membrane surrounding the mass.
Figure 8:
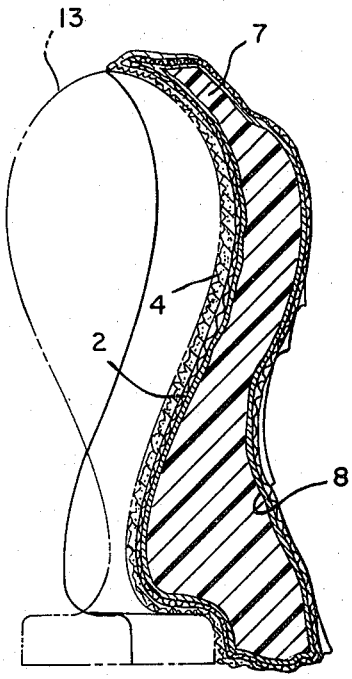
FIG. 8 is a view similar to FIG. 7, but illustrating a mass of the plastic or moldable material encased within a canvas covering through which the material may be molded into any desired shape, and having thereabout a membrane on which a layer of abrasive material is adhesively adherent.

In the embodiment illustrated in FIG. 8, an irregular article 13 the surfaces of which are to be abraded is placed in contact with the abrasive 4 supported on a supporting member 2 or 6 as illustrated in FIGS. 1 and 3, respectively, while the mass 7 of moldable or plastic material is of the type encased within a membrane 8 as illustrated in FIG. 5. Thus it should be apparent that whether or not the mass of moldable plastic material is encased within a membrane, it is conformable to intricate shapes that must be abraded.

Figure 9:
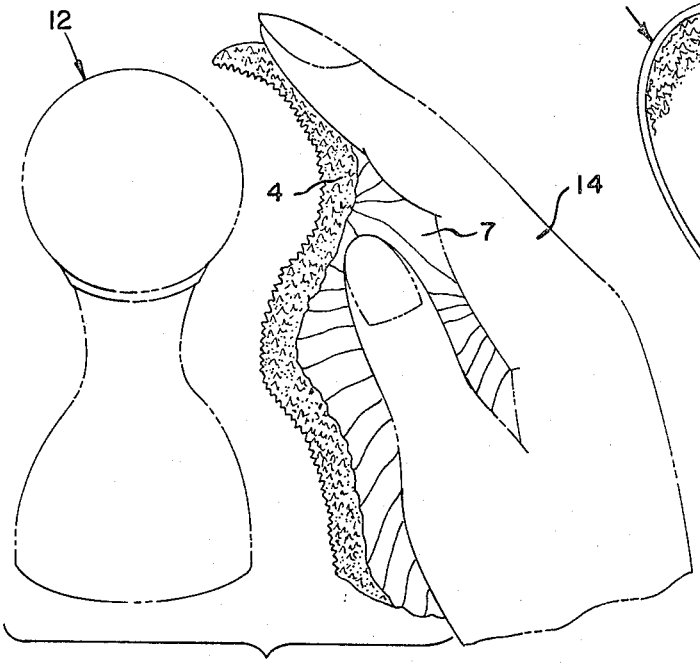
FIG. 9 is a view similar to FIG. 6, but illustrating another method of holding the body of formable material for ease of abrading a surface to be abraded.

FIG. 9 is a figure similar to FIG. 6 illustrating the abrasive material 4 forming one surface of the body 7 and being cupped within a hand 14 to support the entire body as it is being applied to the surface to be abraded.

Figure 10:
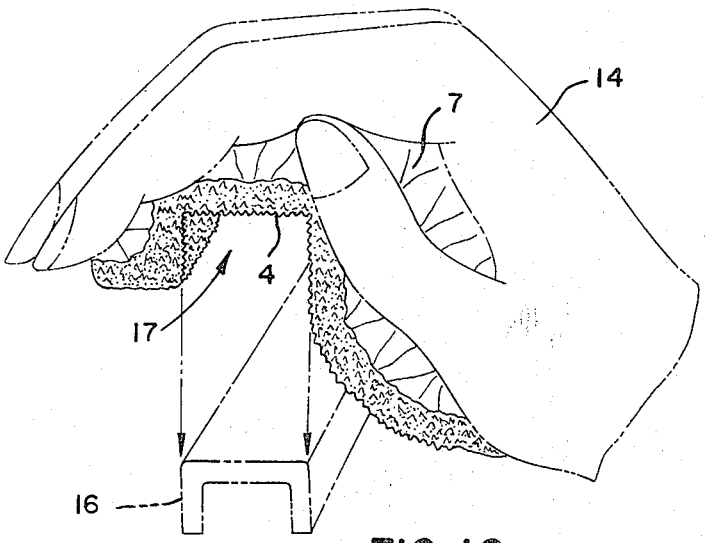
FIG. 10 is a view similar to FIG. 9 and showing the applicability of the moldable abrasive article to a complex shape to be abraded.

In like manner, FIG. 10 illustrates another use for the material, the body 7 here being cupped within a hand 14 as in FIG. 9, but the moldable or plastic body being conformed to a generally channel-shaped member 16, the rectilinear configuration of the channel shaped member being formed as a depression 17 in the body of moldable material and the interior surface of the recess 17 having deposited thereon the abrasive layer 4 as previously discussed. Thus, both lateral sides and the web of the channel may be sanded or abraded simultaneously.

Figure 11:
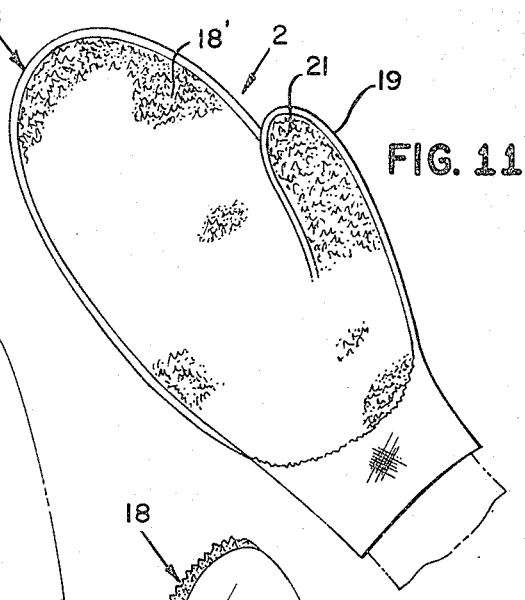
FIG. 11 illustrates a sheet of flexible and moldable material having abrasive material adherent to the exterior surface thereof and formed into the configuration of a mitten to be worn on the hand.

To further facilitate use of the concept, the embodiment illustrated in FIG. 11 illustrates the supporting member 2 formed into the configuration of a mitten designated generally by the numeral 18 and having a surface 18' covered with abrasive material, the palm portion of the mitten being provided with an exterior surface on which the abrasive 18' is deposited, the exterior surface being formed from a layer of woven material such as the layer 2 illustrated in FIG. 1 or the layer 6 illustrated in FIG. 3, while the thumb 19 may also be provided with an abrasive layer 21, while the back 22 of the mitten is devoid of such abrasive material. In this instance, it should be apparent that there is no need for an additional backing such as the mass of moldable or plastic material 7, although if desired, a layer of such material could of course be held in the palm of the hand even after it is inserted in the mitten.

FIG. 13 illustrates another method of using the product illustrated in FIGS. 1 and 3, in this instance the irregular object being a table leg 23 the cylindrical or conical surfaces of which must be abraded uniformly on all sides. To effect such abrading, the layer 2 of supporting material is caused to wrap around the leg so that the abrasive material 4 is next adjacent the exterior surface of the leg as illustrated. Reciprocation of the opposite ends of the rectilinear or circular sheet of supporting material will effect the desired abrading.

Figure 12:
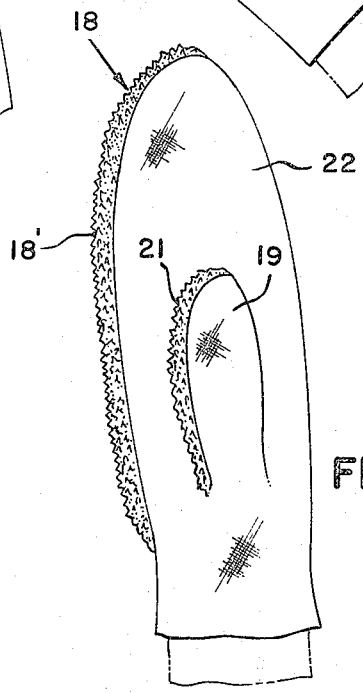
FIG. 12 is a side elevational view of the mitten illustrated in FIG. 11, illustrating the dispersion of abrasive material on the palm and thumb thereof.
Figure 14:
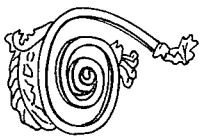
FIG. 14 is a plan view showing ridges and swirls having an irregular configuration that lends itself to being abraded by the subject matter of this invention.

While the concepts illustrated in FIGS. 11 through 13 do not require the use of a supporting mass of plastic material as illustrated in FIG. 7, the intricate carved design illustrated in FIG. 14 would require the use of such a moldable or plastic mass so that the mass could be conformed to the intricate configuration illustrated in that figure.

It will thus be seen that the concept of providing an abrasive surface supported in such a way that it is conformable to intricate patterns so that more than one surface of such patterns may be abraded simultaneously is clearly illustrated and disclosed.

Having thus described the invention, what is desired to be claimed and protected by U.S. Letters Patent is as follows:

1. An article of commerce for abrading irregularly shaped objects comprising:

(a) a sheet of non-resilient flexible woven material cut on the bias so as to be formable to conform to the configuration of an irregularly shaped object having multiple planes and having the further characteristic of retaining said irregular configuration in said multiple planes until the sheet is formed into another configuration;

(b) a layer of flexible adhesive also conformable to said multiple planes and adherent on said sheet material; and (c) abrasive material bonded to said sheet by said adhesive layer, said sheet, adhesive and abrasive being shapable to conform simultaneous to the multiple planes of the irregular surface of an object to be abraded.

2. An article of commerce for abrading irregularly shaped objects, comprising:

(a) a mass of moldable material having the characteristic of plasticity so as to enable said mass to be molded a desired configuration such that the surfaces of said mass conform to an irregularly shaped surface to abraded, said moldable mass having the further characteristic of retaining said desired configuration until said mass is again molded into another configuration; and (b) a layer of abrasive material adherent to said mass and conformable with said mass to the irregularly shaped surface to be abraded.

3. The combination according to claim 2, in which a membrane is adhered to said mass of moldable material, and said abrasive is adhered to said membrane.

4. The combination according to claim 2, wherein said mass having the characteristic of plasticity is enclosed within a membrane which is impervious to fluids and which is conformable with said mass to the irregularly shaped surface to be abraded, wherein a sheet of non-resilient flexible material formable about said mass is disposed over said membrane, and wherein a layer of abrasive material is adhered to said sheet of non-resilient flexible material.

5. An article of commerce for abrading irregularly shaped objects, comprising:

(a) a body of material having the characteristic of plasticity to enable conformation of surfaces of the body of material to an irregularly shaped surface to be abraded, said body of material having the further characteristic of retaining the surface configuration thereof;

(b) a sheet of non-resilient flexible material draped about said body and conformable thereto;

(c) a layer of flexible adhesive adherent on said sheet material; and (d) abrasive material bonded to said sheet by said adhesive layer whereby said sheet, adhesive and abrasive may be shaped to conform to the irregularly shaped surface to be abraded.

6. An article of commerce for abrading irregularly shaped objects comprising:

(a) a mass of moldable material having the characteristic of plasticity so as to enable said mass to be molded into a desired configuration such that the surfaces of said mass conform to an irregularly shaped surface to be abraded, said moldable mass having the further characteristic of retaining said desired configuration until said mass is again molded into another configuration;

(b) a fluid impervious membrane having said mass of moldable material enclosed therein, said membrane being conformable with said mass to the irregularly shaped surface to be abraded;

(c) sheet of non-resilient flexible material formable about said mass disposed over said membrane; and (d) a layer of abrasive material adhered to said sheet of non-resilient flexible material.

7. The combination of claim 6, wherein said mass of moldable material comprises clay.

8. An article of commerce for abrading irregularly shaped objects, comprising:

(a) a body of material having the characteristic of plasticity to enable conformation of surfaces of the body of material to an irregularly shaped surface to be abraded, said body of material having the further characteristic of retaining the surface configuration thereof;

(b) a sheet of fluid impervious material draped about said body and conformable thereto;

(c) an adhesive adherent on said sheet material; and (d) abrasive material bonded to said sheet by said adhesive layer whereby said sheet, adhesive and abrasive may be shaped to conform to the irregularly shaped surface to be abraded.

9. The combination of claim 8, wherein said mass of moldable material comprises clay.

* * * * *